US005362256A

United States Patent [19]

Hashiguchi

[11] Patent Number: 5,362,256

[45] Date of Patent: Nov. 8, 1994

[54] CONNECTOR

[75] Inventor: Osamu Hashiguchi, Tokyo, Japan

[73] Assignee: NEC Corporation, Japan

[21] Appl. No.: 993,084

[22] Filed: Dec. 18, 1992

[30] Foreign Application Priority Data

Dec. 24, 1991 [JP] Japan ..... 3-106249[U]

[51] Int. Cl.[5] ..... H01R 23/02

[52] U.S. Cl. ..... 439/660; 439/733

[58] Field of Search ..... 439/660, 733, 739, 741, 439/743

[56] References Cited

U.S. PATENT DOCUMENTS

| | | | |
|---|---|---|---|
| 3,757,277 | 9/1973 | Yamanoue et al. | 439/660 |
| 4,734,060 | 3/1988 | Kawawada et al. | 439/660 |
| 5,085,601 | 2/1992 | Butcher et al. | 439/660 |
| 5,152,700 | 10/1992 | Bogursky et al. | 439/733 |

*Primary Examiner*—Eugene F. Desmond

*Attorney, Agent, or Firm*—Laff, Whitesel, Conte & Saret

[57] ABSTRACT

A connector is capable of arranging a large number of contacts in an insulator with high density, namely, capable of reducing an arrangement pitch of the contacts. The connector includes a plurality of leaf contacts and an insulator for holding the contacts. The contact comprises a fixed portion fixed to the insulator, an elastic spring portion integrally connected to one end of the fixed portion, and a contact portion integrally connected to one end of the elastic spring portion and being offset from a surface of the fixed portion and the elastic spring portion. The fixed portion has the width substantially equal to that of the elastic spring portion. The contact portion has the width smaller than that of the elastic spring portion. The insulator has a passage hole for passing the contact portion and a holding hole contiguous to the passage hole in a thickness direction of the contact for passing the elastic spring portion and for holding the fixed portion. The passage hole has a width which allows passage of the contact portion while the holding hole has a width which allows passage of the elastic spring portion and which is greater than the width of the passage hole so that stepped surfaces for engaging the fixed portion are formed between the holding hole and the passage hole.

2 Claims, 5 Drawing Sheets

CONNECTOR

BACKGROUND OF THE INVENTION

This invention relates to a connector including a large number of leaf contacts arranged in an insulator.

A conventional connector 1 of the type described includes a plurality of leaf contacts 2 and an insulator 3 for holding the contacts 2, as illustrated in FIG. 1.

Referring to FIG. 2, each of the contacts 2 has a fixed portion 20 fixed to the insulator 3, an elastic spring portion 21 integrally connected to one end of the fixed portion 20, and a contact portion 22 integrally connected to one end of the elastic spring portion 21. As shown in FIG. 3, the elastic spring portion 21 is bent at its other end adjacent to the fixed portion 20, the bend being inwardly in a thickness direction of the contact 2. The contact portion 22 is bent at its intermediate portion in reverse to the elastic spring portion 21, namely, outwardly in the thickness direction of the contact 2. Since the contact 2 is bent in such a manner, the contact portion 22 of the contact 2 is brought into contact with a mating contact of a mating connector inserted into the insulator 3. At this time, an urging force of the elastic spring portion 21 is applied to the contact portion 22. Accordingly, the contact portion 22 is pressed against the mating contact of the mating connector. Since the elastic spring portion 21 and the contact portion 22 are bent as described above, the elastic spring portion 21 and the contact portion 22 protrude inwardly or one offset from one surface of the fixed portion 20 (the surface opposite to the mating contact of the mating connector inserted into the insulator 3).

In the conventional connector 1, the width of the fixed portion 22 is wider than that of the elastic spring portion 21 as illustrated in FIG. 2. The width of the contact portion 22 is equal to that of the elastic spring portion 21.

On assembling the connector 1, the contact 2 is inserted into the insulator 3 from a backside of the insulator 3 and is finally held in the insulator 3. As described above, the elastic spring portion 21 and the contact portion 22 protrude or are offset from one surface of the fixed portion 20. Accordingly, the insulator 3 requires a space for passing the elastic spring portion 21 and the contact portion 22 of the contact 2 in order to insert the contact 2 to a predetermined position within the insulator 3.

In this connection, the insulator 3 has a passage hole 30. The width d' of the passage hole 30 is slightly larger than the widths of the elastic spring portion 21 and the contact portion 22 of the contact 2. The insulator 3 also requires a space for holding the fixed portion 20 of the contact 2. In this connection, the insulator 3 is provided with a holding hole 31. The holding hole 31 is contiguous to the passage hole 30 in the thickness direction of the contact 2 held in the holding hole 31. The width e' of the holding hole 31 is slightly smaller than that of the fixed portion 20 of the contact 2.

Thus, the fixed portion 20 of the contact 2 is pressedly inserted into the holding hole 31 of the insulator 3 and held in the holding hole 31. As illustrated in FIG. 4, the width e' of the holding hole 31 is substantially wider than the width d' of the passage hole 30. With this structure, a pair of stepped surfaces 34 are formed between the holding hole 31 and the passage hole 30. These stepped surfaces 34 engage both side edges of the fixed portion 20 of the contact (2). By means of such an engagement, the contact 2 is located at a proper position in its thickness direction. The sum of the widths of these stepped surfaces 34 (hereinafter simply called the width of the stepped surfaces, is substantially equal to a difference between the width b of the elastic spring portion 21 and the width c' of the contact portion 22.

In the connector of the type described, it is a recent demand to achieve a high-density arrangement of contacts, namely, to arrange a large number of contacts in an insulator at a reduced arrangement pitch.

It is noted that the arrangement pitch of the contacts must be greater than the width of the fixed portion of each contact. Now, consideration will be made as regards two approaches to reduce the arrangement pitch of the contacts. One approach is to reduce the width of the fixed portion of the contact alone. Another approach is to reduce an entire width of the contact.

Practically, it is impossible to adopt the former approach of reducing the width of the fixed portion alone. It is noted that the width of the stepped surfaces is substantially equal to the difference between the width of the fixed portion and the widths of the elastic spring portion and the contact portion as described above. If the width of the fixed portion alone is reduced while the widths of the elastic spring portion and the contact portion are kept unchanged, the width of the stepped surfaces is reduced accordingly. As a result, engagement between the contact and the stepped surfaces becomes unreliable. Thus, when the width of the fixed portion alone is reduced, the contact is unfavorably displaced from a normal portion within the insulator. Accordingly, it is impossible in the conventional connector to reduce the width of the fixed portion of the contact alone.

On the other hand, the latter approach of reducing the entire width of the contact assures the sufficient width of the stepped surfaces. Accordingly, the contact is not displaced from the normal position within the insulator. However, this approach is not practical. If the entire width of the contact is reduced, the width of the elastic spring portion is reduced. The elastic spring portion having such a reduced width can not exert a sufficient urging force against the contact portion. As a result, the contact portion can not be brought into a tight contact with the mating contact of the mating connector.

As described, it is difficult to achieve a high-density arrangement of the contacts in the conventional connector of the type described.

SUMMARY OF THE INVENTION

It is therefore an object of this invention to provide a connector which is capable of arranging a large number of contacts with a high density.

According to this invention, a connector includes a plurality of leaf contacts and an insulator for holding the contacts, the contact comprising a fixed portion fixed to the insulator, an elastic spring portion integrally connected to one end of the fixed portion, and a contact portion integrally connected to one end of the elastic spring portion and being offset from a surface of the fixed portion and the elastic spring portion, the fixed portion having the width substantially equal to that of the elastic spring portion, the contact portion having the width smaller than that of the elastic spring portion, the insulator having a passage hole for passing the contact portion and a holding hole contiguous to the passage hole in a thickness direction of the contact for passing the elastic spring portion and for holding the fixed portion, the passage hole having a width which allows a passage of the contact portion, the holding hole having a width which allows passage of the elastic spring portion and which is greater than the width of the passage hole so that stepped surfaces for engaging the fixed portion are formed between the holding hole and the passage hole.

DESCRIPTION OF THE PREFERRED EMBODIMENT

Figure 1:
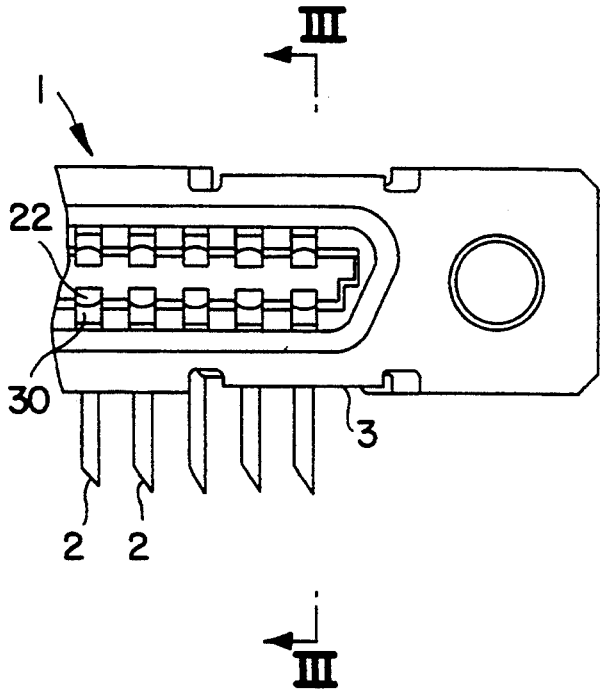
FIG. 1 PRIOR ART
FIG. 1 is a front view of a main portion of a conventional connector.
Figure 2:
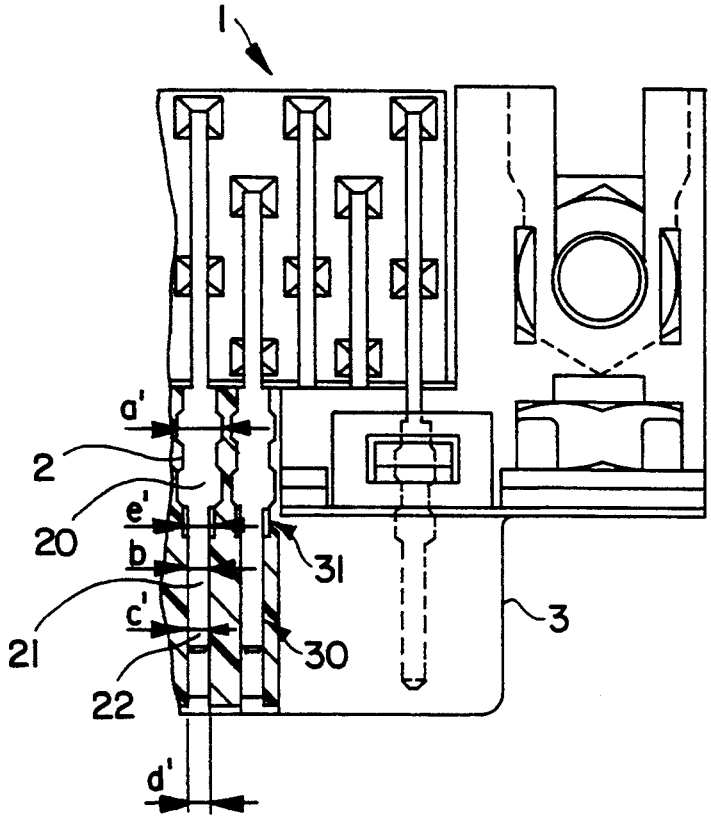
FIG. 2 PRIOR ART
FIG. 2 is a plan view of the connector illustrated in FIG. 1 with a part cut away.
Figure 3:
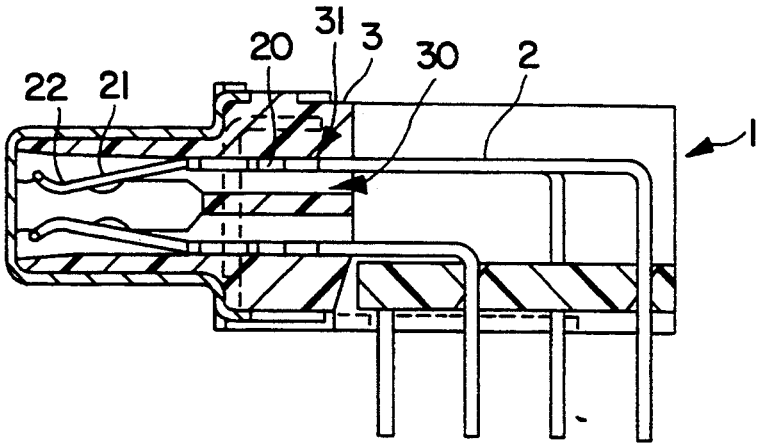
FIG. 3 PRIOR ART
FIG. 3 is a sectional view taken along a line III—III in FIG. 1.
Figure 4:
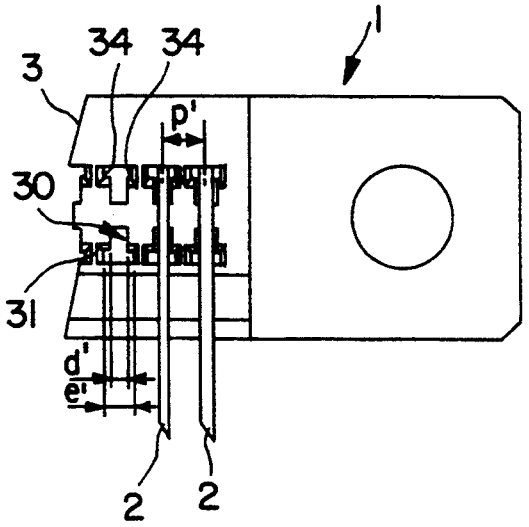
FIG. 4 PRIOR ART
FIG. 4 is a rear view of the connector illustrated in FIG. 1.
Figure 5:
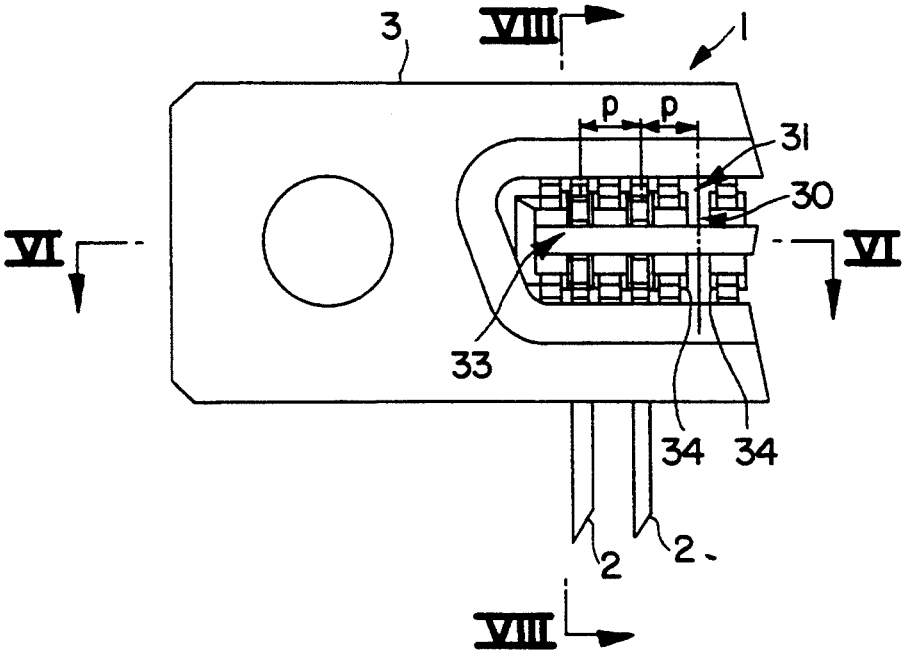
FIG. 5 is a front view of a main portion of a connector according to an embodiment of this invention.
Figure 6:
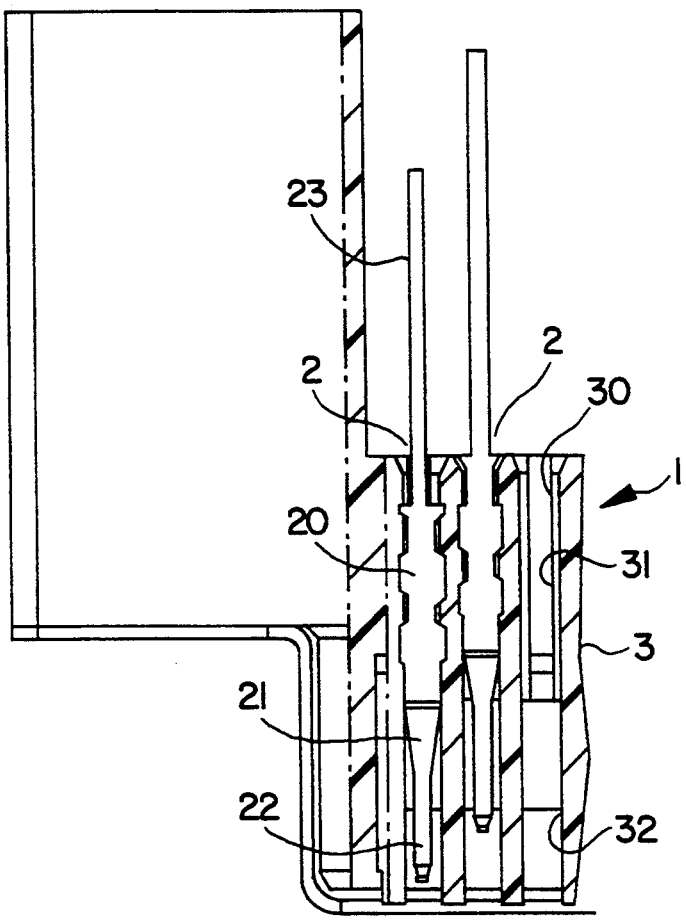
FIG. 6 is a sectional view taken along a line VI—VI in FIG. 5.
Figure 7:
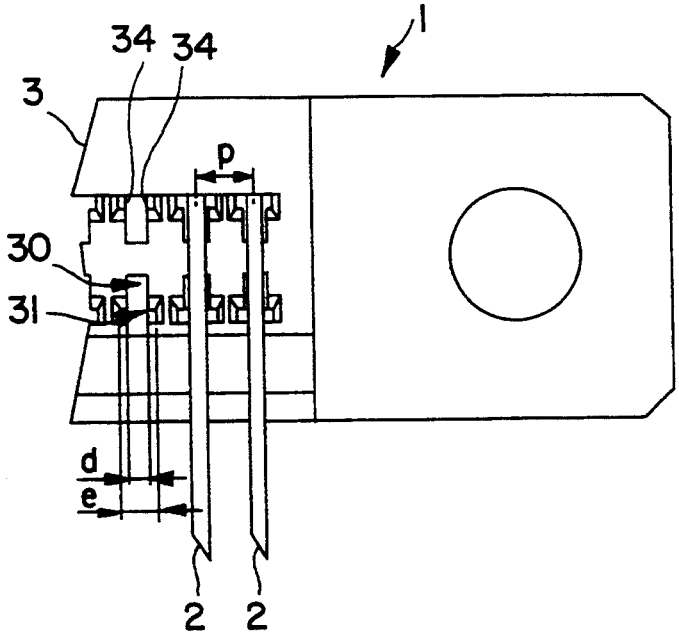
FIG. 7 is a rear view of the connector illustrated in FIG. 5.
Figure 8:
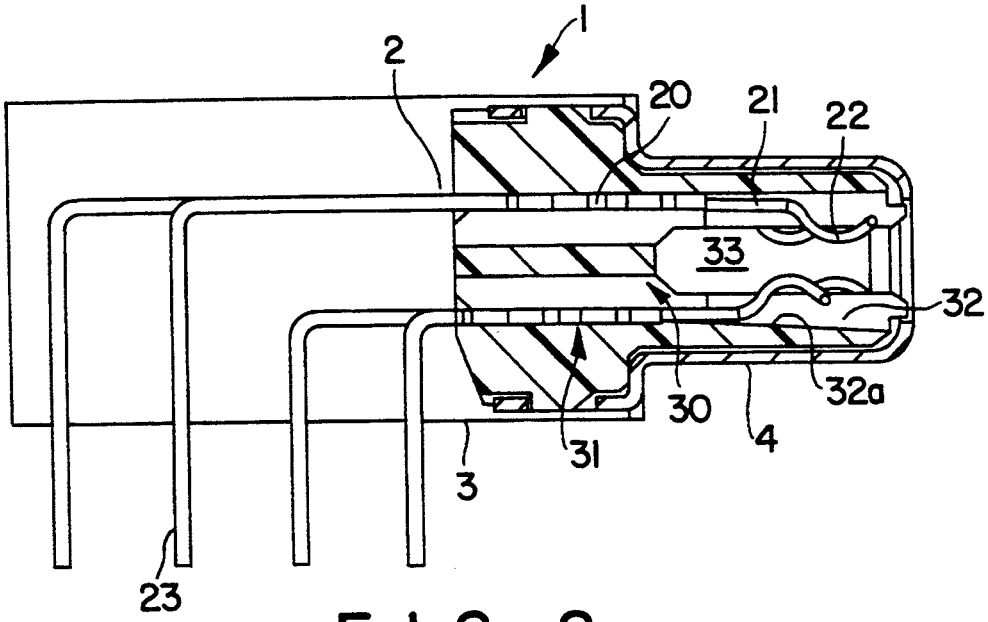
FIG. 8 is a sectional view taken along a line VIII—VIII in FIG. 5.
Figure 9:
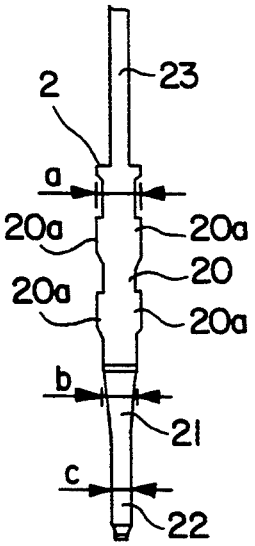
FIG. 9 is a plan view of a contact used in the connector illustrated in FIG. 5.

Referring to FIGS. 5 through 10, a connector 1 according to this invention includes a plurality of contacts 2 and an insulator 3.

Each contact 2 has a leaf shape. As is clearly seen from FIG. 9, the contact 2 comprises a fixed portion 20, an elastic spring portion 21, a contact portion 22, and a wire connecting portion 23. The fixed portion 20 has four projections 20*a*, each of a substantially trapezoidal shape.

The elastic spring portion 21 is integrally connected to one end of the fixed portion 20 in a coupling direction along which the connector 1 is coupled or fitted to a mating connector (not shown). The elastic spring portion 21 has a tapered shape. However, the elastic spring portion 21 may be any appropriate shape, for example, a rectangular shape. The elastic spring portion 21 urges the contact portion 22 against a pin contact (not shown) of the mating connector inserted into a coupling hole 33 (which will later be described) of the insulator 3.

The contact portion 22 is integrally connected to one end of the elastic spring portion 21 in the coupling direction. The contact portion 22 is urged by the elastic spring portion 21 to be brought into press contact with the pin contact of the mating connector inserted into the coupling hole 33. The wire connecting portion 23 is integrally connected to the other end of the fixed portion 20 in the coupling direction. The wire connecting portion 20 is connected to a wire (not shown).

The width (maximum width) a of the fixed portion 20 is slightly larger than the width (maximum width) b of the elastic spring portion 21. Since the elastic spring portion 21 has a tapered shape, the width of the elastic spring portion 21 is not uniform. When the width of the elastic spring portion 21 is not uniform, a widest part of the elastic spring portion 21 must be formed at its other end adjacent to the fixed portion 20. This is because an urging force of the elastic spring portion 21 against the contact portion 22 is caused by the other end adjacent to the fixed portion 20. Inasmuch as the width of this part is maximum even if the remaining part has a reduced width, the urging force against the contact portion 22 is assured.

It is noted here that, throughout the specification, the width b of the elastic spring portion 21 means the maximum width. In the conventional connector illustrated in FIGS. 1 through 4, the width c' of the contact portion 22 is equal to the width b of the elastic spring portion 21. In this invention, the width c of the contact portion 22 is smaller than the width b of the elastic spring portion 21.

On the other hand, one surface of the elastic spring portion 21 opposite to the pin contact of the mating connector inserted into the insulator 3 is substantially flush or coplanar with one surface of the fixed portion 20 opposite to the pin contact of the mating connector. The contact portion 22 is bent in an arcuate shape and offset from the surface of the fixed portion 20 and the surface of the elastic spring portion 21. The thickness of the contact 2 is kept constant from the wire connecting portion 23 to the fixed portion 20 and steeply reduced from a boundary between the fixed portion 20 and the elastic spring portion 21.

Accordingly, the elastic spring portion 21 and the contact portion 22 are smaller in thickness than the fixed portion 20 and the wire connecting portion 23. With this structure, a wider gap is formed between the elastic spring portion 21 and a bottom surface 32*a* of a receptacle groove 32 which will later be described. The gap allows a swinging movement of the elastic spring portion 21 and the contact portion 22.

The insulator 3 has a passage hole 30, a holding hole 32, the receptacle groove 32, and the coupling hole 33. Most of the insulator 3 is covered by a shell 4.

Figure 10:
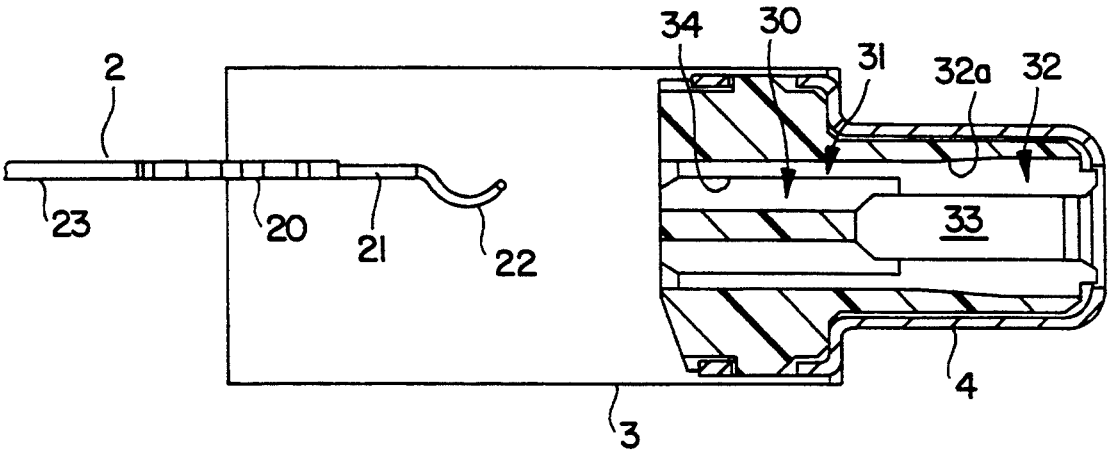
FIG. 10 is a sectional view similar to FIG. 8 for describing a state before the contact is inserted into an insulator.

Referring to FIG. 10, the passage hole 30 is for passing the contact portion 22 of the contact 2 to the receptacle groove 32 when the contact 2 is assembled into the insulator 3, the assembly being from a backside of the insulator 3. In the conventional connector illustrated in FIGS. 1 through 4, the passage hole 30 is for passing the elastic spring portion 21 and the contact portion 22 of the contact 2. In this invention, the passage hole 30 is for passing the contact portion 22 alone.

The holding hole 31 is contiguous to the passage hole 30 in the thickness direction of the contact 2 held in the holding hole 31. The holding hole 31 serves to pass the elastic spring portion 21 of the contact 2 to the receptacle groove 32 when the contact 2 is assembled into the insulator 3. The holding hole 31 also serves to hold the fixed portion 20 of the contact 2 inserted into the holding hole 31.

The receptacle groove 32 receives the elastic spring portion 21 and the contact portion 22 of the contact 2 located at a predetermined position in the insulator 3. When the pin contact of the mating connector is inserted into the coupling hole 33, the elastic spring portions 21 and the contact portions 22 of a pair of opposite contacts 2 are forced by the pin contact to be outwardly deflected. Accordingly, the insulator 3 must have a space to allow such deflection of the contact 2. In this connection, among wall surfaces of the receptacle groove 32, one surface 32*a* (hereinafter referred to as a bottom surface of the receptacle groove 32) opposite to the contact 2 has a tapered shape. Thus, a gap is formed between the bottom surface 32*a* of the receptacle groove 32 and the elastic spring portion 21 of the contact 2. The gap serves as a space allowing the deflection of the contact 2. The coupling hole 33 is formed at a top end of the insulator 3 in the coupling direction. The pin contact of the mating connector is inserted into the coupling hole 33.

As described above, the passage hole 30 is for passing the contact portion 22 of the contact 2 and therefore has the width d slightly larger than the width c of the contact portion 22. The holding hole 31 is for passing the elastic spring portion 21 of the contact 2 and for holding the fixed portion 20 of the contact 2. Therefore, the holding hole 31 has the width e slightly larger than the width b of the elastic spring portion 21 and slightly smaller than the width a of the fixed portion 20. The width e of the holding hole 31 is wider than the width d of the passage hole 30.

With this structure, a pair of stepped surfaces 34 are formed between the holding hole 31 and the passage hole 30. These stepped surfaces 34 engage the contact 2 held in the holding hole 31 to locate the contact 2 at a proper position in the thickness direction. A sum of widths of the stepped surfaces 34 (hereinafter simply referred to as the width of the stepped surfaces 34) is equal to a difference between the width b of the elastic spring portion 21 and the width c of the contact portion 22.

As described above, in the conventional connector 1, the width of the stepped surfaces 34 is substantially equal to a difference between the width a' of the fixed portion 20 and the width b of the elastic spring portion 21. Accordingly, in the conventional connector 1, when the width a' of the fixed portion 20 alone is reduced in order to reduce the arrangement pitch p' of the contacts 2, the width of the stepped surfaces 34 is reduced also. This results in the disadvantage described in the preamble of the instant specification. On the other hand, in this invention, the width of the stepped surfaces 34 is determined by a difference between the width b of the elastic spring portion 21 and the width c of the contact portion 22, irrespective of the width a of the fixed portion 20. Inasmuch as the width c of the contact portion 22 is substantially smaller than the width b of the elastic spring portion 21, the contact 2 is reliably held by the stepped surfaces 34 even if the width a of the fixed portion 20 is reduced to be equal to the width b of the elastic spring portion 21.

Thus, it is possible according to this invention to reduce the arrangement pitch p of the contacts 2 by reducing the width a of the fixed portion 20. The width b of the elastic spring portion 21 is kept wide enough to assure a sufficient urging force. The width of the receptacle groove 32 is equal to the width e of the holding hole 31.

In this embodiment, the width a of the fixed portion 20 of the contact 2 is slightly greater than the width b of the elastic spring portion 21. However, the contact 2 is not restricted to such a structure, as will readily be understood from the foregoing description. Specifically, the width a of the fixed portion 20 may be equal to the width b of the elastic spring portion 21. In this case, the thickness of the fixed portion 20 must be greater than the thickness of the elastic spring portion 21 so that the fixed portion 20 is pressedly inserted into the holding hole 31. As described, the width a of the fixed portion 20 of the contact 2 is equal to or slightly larger than the width b of the elastic spring portion 21. In other words, the fixed portion 20 has a width substantially equal to that of the elastic spring portion 21.

What is claimed is:

1. An electrical connector for use together with a mating electrical connector having a plurality of mating contacts, said electrical connector comprising an insulator (3) and a plurality of leaf contacts (2) assembled to said insulator, each of said leaf contacts (2) comprising:

a fixed portion (20) having a first width (a) which is fixed in said insulator (3);

a contact portion (22) having a second width (c) which is smaller than said first width (a) for making contact with a corresponding one of said mating contacts when said electrical connector is connected to said mating electrical connector, said contact portion (22) being offset from a surface of said fixed portion (20) in an offset direction; and a spring portion (21) having a width (b) which is not larger than said first width (a) and connecting with an end of said fixed portion (20) and an end of said contact portion (22) and being formed integral therewith, said spring portion (21) urging said contact portion (22) to engage said mating contact to insure a contact condition between said contact portion (22) and said mating contact, said insulator (3) comprising:

a plurality of holding holes (31), each of said holding holes being formed to extend into said insulator (3) with a width corresponding to said first width (a) so that each of said holding holes (31) fixedly holds said fixed portion (20) of each of said leaf contacts and enables said spring portion (21) of each of said leaf contacts (2) to pass therethrough; and a plurality of passages (30) formed in said insulator to extend in parallel with said holding holes (31), respectively, said passages being contiguous to, and along, respective ones of said holding holes (31), each of said passages (30) having a width which is smaller than said first width (a) but slightly larger than said second width (c) so that said contact portion (22) passes through a corresponding one of said passages (30) when each of said contacts is assembled into said insulator (3) in order to force said fixed portion (20) into the corresponding one of said holding holes (31).

2. An electrical connector claimed in claim 1, wherein said spring portion (21) has a thickness which is smaller than a thickness of said fixed portion (20), said spring portion having a surface which is substantially flush and coplanar with the first mentioned surface of said fixed portion.

* * * * *